US006109673A

United States Patent [19]

Olshausen

[11] Patent Number: 6,109,673

[45] Date of Patent: Aug. 29, 2000

[54] TAMPER-EVIDENT SEAL WITH REUSABLE CATCHES AND TEAR-OFF ID-TAG

[76] Inventor: Michael Cohnitz Olshausen, P.O. Box 2075, Bristol, Pa. 19007

[21] Appl. No.: 09/369,350

[22] Filed: Aug. 6, 1999

[51] Int. Cl.[7] ..... B65D 27/30

[52] U.S. Cl. ..... 292/307 A; 292/307 R

[58] Field of Search ..... 292/307 R, 307 A, 292/317–321, 325; 24/573.1; 40/628; 283/105

[56] References Cited

U.S. PATENT DOCUMENTS

| | | | |
|---|---|---|---|
| 446,653 | 2/1891 | Wheeler | 292/321 |
| 1,012,882 | 12/1911 | Martineau | 292/318 |
| 1,365,477 | 1/1921 | Roeling | 292/307 A |
| 3,066,501 | 12/1962 | Charles | 63/39 |
| 3,980,332 | 9/1976 | King | 292/317 |
| 4,645,087 | 2/1987 | Kusz | 215/254 |
| 4,811,844 | 3/1989 | Moulding | 206/459 |
| 5,765,885 | 6/1998 | Netto | 292/318 |

*Primary Examiner*—B. Dayoan
*Assistant Examiner*—Gary Estremsky

[57] ABSTRACT

A material-economizing, tamper-evident seal is disclosed having dual, non-contiguous, symmetrically placed, reusable catches and a tear-off identification tag. Should seal replacement become necessary, the seal's identification tag is first torn off, and then the remainder of the seal is passed through one of the catches. A replacement seal with its own identification tag may then be engaged with both of the catches. The invention's preferred embodiment allows easy rotation of the identification tag, thus facilitating inspection of the tag's identifying mark, typically a serial number. The tag's tear-off feature is effected by the presence of an abscission bead, which may take one of several forms, as, for example, a row of perforations. Whereas some of the invention's components are preferably molded out of a resilient and relatively weak, thermoplastic material such as polypropylene, other components may with advantage be molded out of a much-stronger material, such as polycarbonate, instead.

17 Claims, 3 Drawing Sheets

TAMPER-EVIDENT SEAL WITH REUSABLE CATCHES AND TEAR-OFF ID-TAG

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention generally relates to tamper-evident seals, and in particular to tamper-evident seals having a surface for the display of an identifying mark, typically a serial number, and having, furthermore, a weak section that is lockably held by a catch-mechanism, this weak section irreversibly breaking when access or entry is sought into the space to the portal of which the seal has been protectively affixed. Tamper-evident seals frequently are used to deter entry by persons who, in at least some circumstances, of which it is desired to limit the number and kind, may actually seek entry validly and justifiably.

In one, commonly-met arrangement, metal anchorages equipped with apertures—such as a pair of welded eyebolts, or a pair of right-angle plates with bored apertures, etc.—are mounted, one apiece, on a door and door frame. A tamper-evident seal is then passed through each of the apertures, whereupon the seal is clasped together, it's weak section now lockably held by its catch. To open the door, the seal must either be broken or the seal's catch-mechanism must be defeated without, however, leaving visible evidence of an unauthorized entry.

Often, tamper-evident seals are molded out of thermoplastics such as polypropylene, and cost, exclusive of amortized mold costs, a few pennies apiece. Tamper-evident seals are thus considerably more economical than electronic security devices and, very often, are more cost-effective, as well. The above-mentioned, identifying marks typically are hot-stamped onto, or are embossed, or cast directly, into the seals' thermoplastic material. Tamper-evident seals made variously out of wax, metal, ceramic or even of paper elements have been in widespread use since antiquity.

A disadvantage of nearly all tamper-evident seals is that, upon breakage of the seal, the entire seal becomes discardable waste. Were some functional part of the seal to be made reusable, however, then a supply of such seals, as might be packaged with a consumer product, would require considerably less packaging than a supply of seals destined over time to be discarded entirely. Since waste-reduction marginally reduces production costs and externalizes a smaller recycling load, such savings are clearly desirable. Since reduced packaging-space roughly translates into reduced, end-user, storage space, end-user, product appeal is enhanced, as well. This is true most especially for a society that is awash in manufactured "goods".

A tamper-evident seal that provides a single opportunity for reuse is taught by U.S. Pat. No. 5,522,627 (Swift; Jun. 4, 1996). The reusability of this seal, however, although doubtless of advantage in certain circumstances, does not appear to be especially advantageous either for discouraging and/or for deterring and/or preventing unauthorized entry into a seal-protected space. The party desiring to control entry may simply fail to notice that a seal so subtly constructed had been reused.

A readily identifiable, multiply-reusable, tamper-evident seal would therefore appear to have some general utility. Such a seal might be usefully combined with an existing security product in order to enhance that product's appeal. One example of such a product is the anti-snooping device for apartment dwellers disclosed by U.S. Pat. No. 5,875,660 (Olshausen; Mar. 2, 1999).

BRIEF SUMMARY OF THE INVENTION

The present invention begins by taking the catch-mechanism of a typical, tamper-evident seal and so separating this catch-mechanism from the seal's weak section that these two elements, catch-mechanism and weak section, if not lockably engaged with one another, remain not only not contiguous with one another, but not mutually contiguous with any, other element, or with any other, serially-contiguous elements, of the tamper-evident seal. Contiguous is taken here to mean that two, physically-distinct seal-elements touch at least at one point.

The present invention employs two such catch mechanisms, and thus is especially well-adapted to linking two moveable objects, such as a desk and desk-drawer, or a gun-locker and gun-locker door, with a tamper-evident seal. The present invention attaches one catch-mechanism apiece to each of these two objects, by means, for example, of a split, chain link with a crimpable sleeve mounted thereupon. The two catch mechanisms are then brought into separate, and simultaneous, locking engagement with a third, double-studded element, called the engaging element, also called the seal-element, from which a prominent, tear-off, identification tag depends. This third, double-studded, engaging element is physically weakest where its two studs join opposite ends of this element's main body. Each stud lockably engages one of the catch-mechanisms. If the aforesaid, two objects are now forcefully pried or pulled parted, the locked engagement of the seal-element with the two catch-elements will be broken, irreversibly. One of the studs, if not both, will forcibly be broken off. To reconstitute the entire, tamper-evident seal after one of the studs has been broken off, the identification tag is first torn-off the seal-element, and then the remainder of the seal-element is pushed through the catch-element that still lockably engages the one remaining stud, until this seal-remainder passes clear of, and falls out of, the catch. With both catch-elements now freed for reuse, a replacement, double-studded seal-element, possibly bearing a new serial number, can be brought into locked engagement with both of the catches, thereby reconstituting the overall, tamper-evident seal.

The catch-mechanisms of tamper-evident seals very often contain resilient, converging elements, generally called fingers, that allow the passage of an abruptly-shouldered stud, in the present invention a sub-element of the seal-element, through and past the fingers in one direction only. Following the stud's passage, the fingers spring back behind the stud's shoulder, thus preventing so securely movement of the stud in the opposite direction that a forceful attempt to yank the stud out of the seal's catch simply, and irreversibly, breaks off the stud. The various catch-mechanisms of the tamper-evident seals disclosed in U.S. Pat. No. 5,522,627 (Swift; op. cit.), U.S. Pat. No. 4,664,432 (Swift; U.S. Pat. No. 4,664, 432) and U.S. Pat. No. 1,553, 188 (Sauton; Sept. 8, 1925) all embody this feature.

Noteworthy about nearly all tamper-evident seals is that, when the seals are stressed, the weak point at which breakage occurs typically is not to be found within the seals' respective catch-mechanisms. That is, the catch-mechanism of a particular, tamper-evident seal is ordinarily quite strong relative to another element, very often an abruptly-shouldered stud, that is intentionally designed to be fairly easily severed. By suitable choice of materials and/or by suitable design strategies, discussed further below, catch-mechanisms may be made quite robust, capable of withstanding many reuses.

Tamper-evident seals having double catches have been disclosed in the patent literature, but generally these catches are mutually contiguous with another element, or with other, serially-contiguous, elements of the overall, tamper-evident seal. Thus, for example, U.S. Pat. No. 271,684 (Clarke; Feb. 6, 1883) discloses "a two-pronged, seal shackle and a sealing bar. . . each prong having an aperture constructed to receive an end of the sealing bar." The prongs of Clarke's shackle remain joined, however, and are therefore contiguous, or else they are jointed by means of a mutually contiguous rivet, and thus are serially contiguous. U.S. Pat. No. 1,553,188 (Sauton; op.cit.) shows a symmetric, double-studded seal-element that lockably engages two distinct catches, both of which catches, however, are contiguous to the same, intervening body, and thus are serially contiguous. U.S. Pat. No. 1,930,560 (Keidel; Oct. 17, 1933) shows a seal entirely comprising metal elements and having two catches, both of which, however, are stamped into a single metal plate, and thus are also serially contiguous. In the present invention, the dual catches are not contiguous themselves, nor are they mutually contiguous with any, other seal-element, nor with any other, serially-contiguous, seal-elements prior to the locking engagement of the two catches with the double-studded seal-element that bears the tear-off, identification tag. Subsequent to this locking engagement, all the elements of the present invention become either contiguous or serially contiguous.

In the present invention, each catch-mechanism is contained in a housing that is supported by and carried by a ring-like, housing-support structure. This ring-like, housing-support structure may be integrally formed, as by molding, both with the catch-housing and its internal catch-mechanism. Furthermore, the catch-housing and its ring-like, housing-support structure are dimensionally of the same order of magnitude. Consequently, very little room is available behind the catch-housing for direct or easy insertion into it of tools with which to manipulate the catch-mechanism's resilient fingers. Succeeding in such an effort is, in any event, easier said than done, without leaving a visible trace of attempted entry. Defeating the catches of the present invention is made all the more difficult by the obstruction of direct access into each catch-element's housing by the catch's ring-like, housing-support structure.

The security of a space protected by a tamper-evident seal may be enhanced by means of sudden, seal, color changes, as well. Usually, however, changing seal-color necessitates buying several sets of variously colored, conventional, tamper-evident seals. The savings effected by the present invention through its elimination of redundant waste might thus be dedicated to the production of seal replacement-sets having, say, three or four, distinctive colors. The present invention thus allows seal-color changes to be more cost-effectively implemented by the end-user. In situations where a tamper-evident seal of the present design may be usefully employed, a manufacturer might seek, in this manner, to gain a competitive advantage.

With the foregoing in mind, it is an important object of the present invention to minimize the storage space needed to accommodate a set of replacement, tamper-evident seals.

It is yet another object of the present invention to provide an easy-to-use, multiply-reusable, tamper-evident seal that, by reusing a functional component, minimizes disposable waste and reduces marginal production costs.

It is yet another object of the present invention to provide a tamper-evident seal in which the security of the seal's catch-mechanism is enhanced relative to many, standard designs.

It is still another object of the present invention to offer end-users enhanced security through cost-effectively implemented, seal-color changes.

The above and still-further objects and advantages of the present invention will become apparent from a consideration of the following detailed specification, drawings, and appended claims.

BRIEF DESCRIPTION OF THE SEVERAL VIEWS OF THE DRAWING

Referring to the drawings, wherein like reference characters indicate like parts or elements throughout the several views, and wherein arrowheads indicate compound objects whose numbered resolution into constituent parts occurs when it is germane to the discussion.

DETAILED DESCRIPTION OF THE INVENTION

Figure 1:
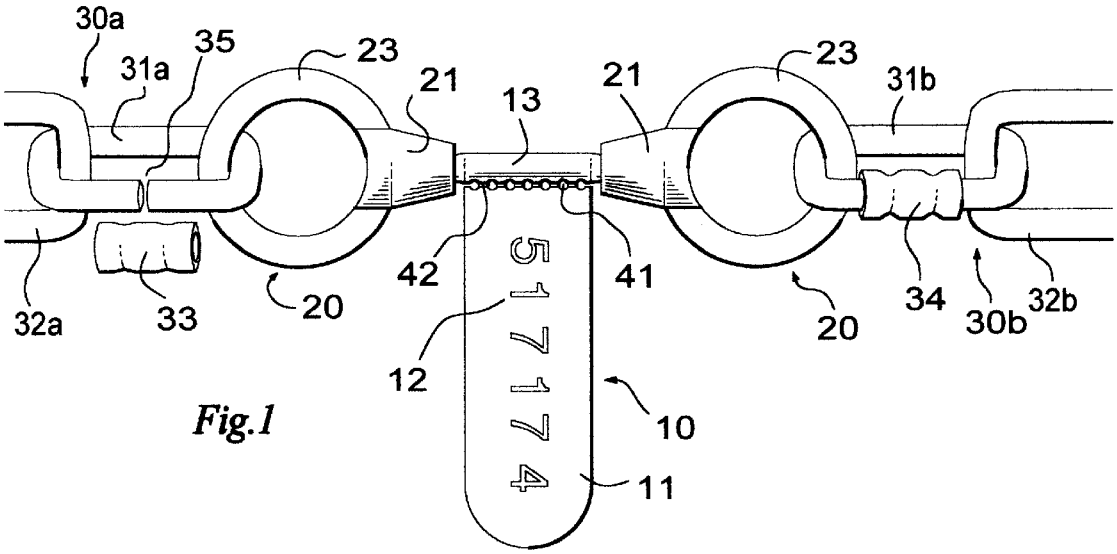
FIG. 1 is an elevation front view of one embodiment of the present invention, showing the elements thereof in locked engagement with one another, and showing the embodiment as a whole in engagement with an extrinsic device.

FIG. 1 shows catch 20 connected to chain 30*a*, and a second catch 20, identically formed, connected to chain 30*b*. Catch 20 comprises catch-housing 21 and catch-ring 23. Each chain, 30*a* or 30*b*, serves to connect its respective catch 20 to one of a pair of objects, such as an apartment door and door-frame, lying outside the frame of the figure. Other means of connection, such as a malleable-rivet connecting link, might be used, instead. Indeed, catch-ring 23 might itself serve as a connector, were it to be formed, for example, with an oblique, overlapping split, analogous to the split in a key-ring, capable of opening over an anchorage in order to admit a portion thereof, and thereupon of being irreversibly closed by mechanical and/or chemical means. If such a catch 20 were to be cast in polycarbonate, then the chemical closure of the overlapping split would be both easy to accomplish and would cure to great strength.

Chains 30*a* and 30*b* have ordinary links 32*a* and 32*b* and split links 31*a* and 31*b*, respectively. In practice, chains 30*a* and 30*b*, and these chains' various components will often be identical in form, just as they are in FIG. 1, although this needn't be the case. Split link 31*a* is pried apart, catch-ring 23 is passed through thus-widened gap 35, whereupon split link 31*a* is returned to its original alignment, shown in the figure, with the result that it now embraces its respective catch 20. Split-link 31*b* is handled likewise, so that it, too, embraces a second, identically-formed catch 20. While pried apart, each split link 31*a* and 31*b* receives an identical sleeve 33, which, subsequent to split links 31*a* and 31*b* being returned to their original alignment, is slid along each split link until gap 35 in each is covered. Sleeve 33 is then forcibly crimped, forming crimped sleeve 34, so that split links 31*a* and 31*b* are secured against further prying.

Seal-element 10, having identification tag 11 bearing identification mark 12 (shown, for illustrative purposes only, to be a randomly-chosen serial number) and having bilaterally symmetrical midsection 13, is shown to be in simultaneous, locked engagement with each of the two catches 20. Identification tag 11 depends from bilaterally symmetrical seal-midsection 13, to which it is attached by perforation-teeth 42 separated by perforation holes 41. Tag 11 will typically be long and flat, and thus will typically have a maximum length, a uniform width, and a uniform thickness, except, however, that the thickness may vary in the vicinity of identification mark 12, especially if identification mark 12 is embossed or cast into the material forming tag 11. If identification mark 12 had no, discernable effect upon thickness, or were ideally regarded as having no effect, then tag 11 could be generally regarded as having a body having a uniform thickness, as indeed the ordinary description of tag 11 typically does. Details of the attachment of tag 11 to seal-midsection 13 are discussed below.

Figure 2:
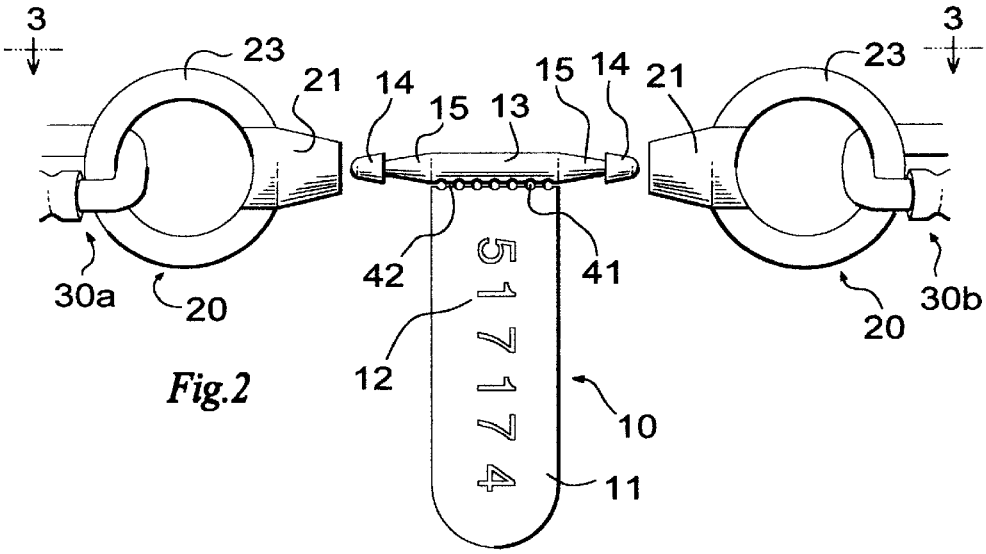
FIG. 2 is an elevation front view of the embodiment of the invention shown in FIG. 1, but showing the elements thereof prior to their locked engagement, and showing somewhat less of the engaged, extrinsic device.

FIG. 2 shows catch 20 connected to chain 30*a*, and a second, identically-formed catch 20 connected to chain 30*b*, with seal-element 10 positioned symmetrically between, but not in locked engagement with, either catch 20. Seal-element 10 has bilaterally symmetrical midsection 13 at the ends of which are identically-formed, co-axial, rotationally symmetrical, tapered sections 15. Tapered sections 15 each have the same, maximum diameter, which is equal to the diameter of seal-midsection 13 where tapered sections 15 join the two, opposite, bilaterally-symmetric ends of seal-midsection 13. Identically-formed, co-axial, rotationally symmetrical, abruptly-shouldered studs 14 join tapered sections 15 at the distal, narrow ends of tapered sections 15. Studs 14 are co-axial with tapered sections 15. Seal-element 10 is shown to be not contiguous with either catch 20, and to be not contiguous with either chain 30*a* or chain 30*b*, and thus is shown to be not contiguous with any of these serially-contiguous, physical objects. This arrangement is in marked distinction to the typical arrangement, shown, for example, in U.S. Pat. No. 4,588,218 (Guiler, et al; May 13, 1986), wherein strict contiguity among the various elements of the tamper-evident seal is maintained, whether or not the seal is closed.

Figure 3:
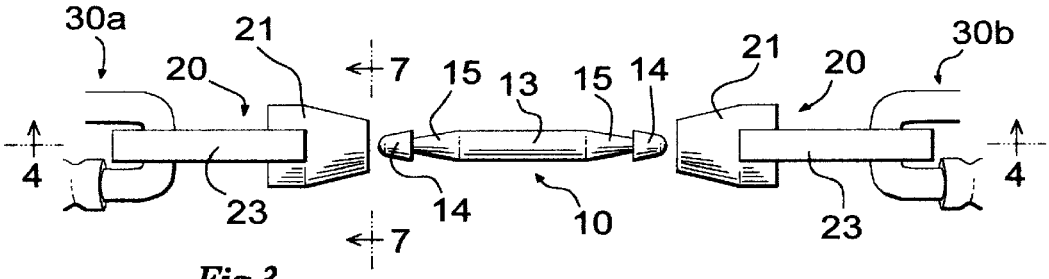
FIG. 3 is an elevation top view of the embodiment of the invention shown in FIG. 2, taken through line 3—3 of FIG. 2.

FIG. 3 shows the elements in FIG. 2 but seen now from above, through lines 3—3 of FIG. 2.

Figure 4:
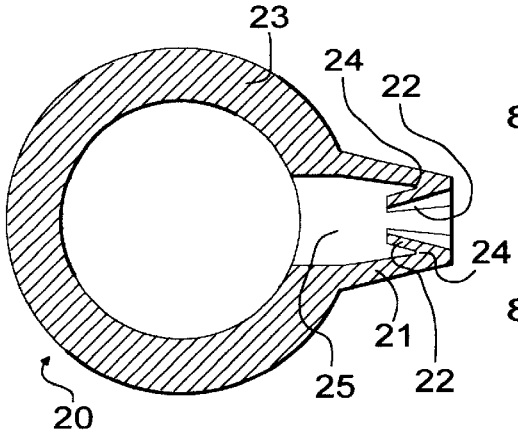
FIG. 4 is a cross-sectional view of one of the elements of the present invention take through line 4—4 of FIG. 3.

FIG. 4 shows one catch 20 in cross-section, taken along line 4—4 of FIG. 3. Resilient fingers 22 extend in a convergent manner into cavity 25 of catch-housing 21. Each resilient finger 22 joins catch-housing 21 along interior, circular junction 24, shown here in cross-section. For added strength, interior circular junction 24 is filleted. A filleted junction will transmit applied stress more uniformly from resilient fingers 22 to the material of which catch-housing 21 is composed than would an acutely-angled junction that is also sharp. Such a non-filleted junction will serve to concentrate stress.

Figure 5:
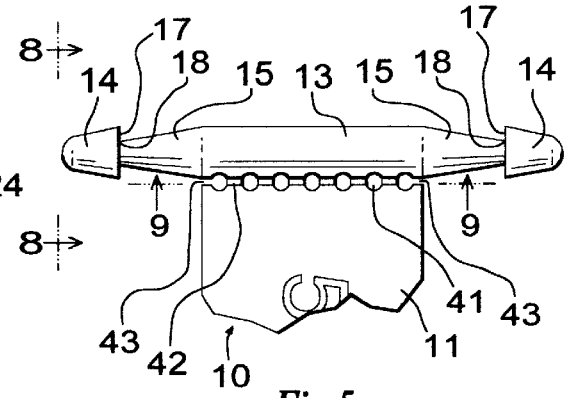
FIG. 5 is a fragmented, front elevation view of the central element of the present invention shown in FIG. 2.

FIG. 5 shows in greater detail than FIG. 2 the attachment of identification tag 11 to bilaterally symmetrical midsection 13 of seal-element 10. Perforation teeth 42 are co-linear and are disposed at regular intervals along the length of seal-midsection 13 of seal-element 10, thus connecting identification tag 11 to seal-midsection 13. Perforation holes 41 separate perforation teeth 42 one from another. The volume of the material contained in the sum of all the perforation teeth 42 will be substantially less than the volume of the material contained in a cross-section of tag 11 taken parallel to, and proximate to, perforation teeth 42 and in width equal to the width of perforation teeth 42. Perforation teeth 42 thus form an abscission bead, analogous to a botanical abscission layer, that is weak compared to the adjacent material. In order to facilitate the tearing-off of tag 11 from the remainder of seal 10, the last, possible perforation tooth 42 at either end of bilaterally symmetrical seal-midsection 13 has been omitted, resulting in gaps 43 between identification tag 11 and seal-midsection 13. The twisting force minimally needed to tear off tab 11 from seal-midsection 13 will thus be transmitted more readily to those perforation teeth 42 that actually are present. The abscission bead that is formed by the linear array of perforation teeth 42 thus has a length that is somewhat less than the width of tag 11 at the point where tag 11 is proximate to seal-midsection 13.

Conventional, tamper-evident seals also frequently have ID-tags, but these tags' removal is typically only to be accomplished by means of a scissors. Such a method of removal would be quite awkward in the case of the present invention.

FIG. 5 further displays, in greater detail than FIGS. 2 or 3, the junctions between co-axial, rotationally symmetrical, identically-formed studs 14 and co-axial, rotationally symmetrical, identically-formed, tapered sections 15 of seal-element 10. Each rear face 17 of each stud 14 forms a abrupt shoulder with respect to the immediately contiguous tapered section 15, in that it meets this tapered section 15 nearly orthogonally at external, circular junction 18. Junction 18 is left unfilleted in order to concentrate applied stress, thereby facilitating the breakage of stud 14 away from its contiguous, tapered section 15 when seal-element 10, as a whole, is stressed, as, for example, when a sudden pulling force is transmitted to seal-element 10 via the catches 20. Which of the two studs 14 will break off first from any particular seal-element 10 under a particular application of a given force will, of course, be determined by microscopic, local differences in material composition, and is, to all intents and purposes, happily unpredictable. Each of the co-axial, rotationally symmetrical, identically-formed tapered sections 15 of seal-element 10 reaches its narrowest diameter at its respective junction 18.

Figure 6:
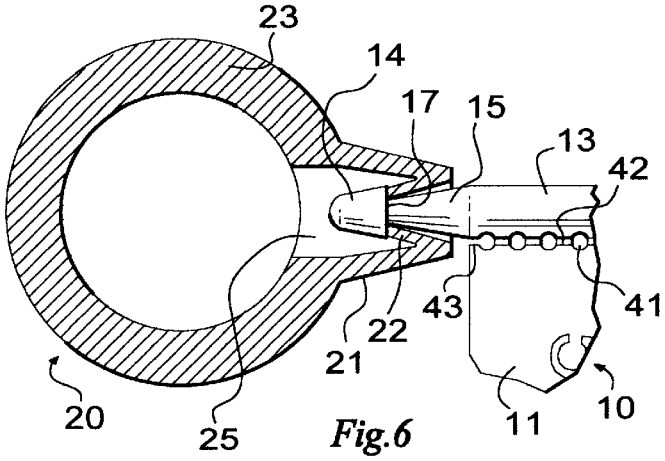
FIG. 6 shows the element of FIG. 4 in locked engagement with one of the symmetrical ends of the element shown in FIG. 5.

FIG. 6 shows seal-element 10 in locked engagement with catch 20, shown here in cross-section, as in FIG. 4. Stud 14 has been pushed through and past resilient fingers 22, which have in turn snapped back behind stud 14, so that they rest on rear surface 17. Resilient fingers 22 thus behave like the pawls of a ratchet, permitting movement in one direction past them, but prohibiting movement past them in the opposite direction. When stud 14 is lockably engaged by catch 20, as shown in FIG. 6, stud 14, tapered section 15, and resilient fingers 22 all share a single axis about which they can rotate. Because the embodiment of the present invention shown in FIGS. 1–16 allows for this shared, rotational axis, seal-element 10 can easily be rotated about it, despite being simultaneously in locked engagement with both catches 20. This free rotation facilitates easy inspection of identification mark 12, should this ID-mark be placed on one face only of tag 11.

It would be possible to embody the present invention in a manner that did not allow for such a rotation, however. All that is definitely required is that seal-midsection 13 have a cross-sectional area orthogonal to its longest dimension that is not greater than and that is geometrically substantially similar to the maximum, parallel cross-sectional area of the element—in the present embodiment, stud 14—that initially and lockably engages catch 20. It would be quite possible, for instance, to use a pawl-type, catch-mechanism like the catch-mechanism shown in U.S. Pat. No. 4,910,831 (Bingold; May 27, 1990), wherein the teeth of that invention's saw-toothed channel each, individually, take on the one-way function of the abruptly-shouldered stud in the present invention. Were such a linear ratchet to be embodied in the present invention, then the then-relevant seal-midsection would need to have an orthogonal cross-section that was similar to, and no greater in area than, the maximum, orthogonal cross-section of strap 12 of Bingold's invention. The reason for this requirement, as FIG. 15, below, will make clear, is that, in the present invention, the seal's midsection must be able to pass through either of the two catch-mechanisms, just as did the sub-elements of the seal that lockably engaged the two catches initially. The emphasis herein on the embodiment of the present invention shown in FIGS. 1–16 is intended to merely highlight the quite useful ability of seal-element 10 of the present, preferred embodiment to rotate.

The wall thickness of catch-housing 21 may be increased without negative effect upon the resiliency of resilient fingers 22, and in fact with considerable, positive effect upon the strength of the catch-mechanism that resilient fingers 22 constitute. Seal-element 10 has two, bilaterally symmetric cross-sections, each located at a junction 18, and each of which is small and hence weak compared to parallel cross-sections of catch 20. The amount of material that maintains the dimensional and functional integrity of catch 20 may be made several times greater, as evidenced in any particular, orthogonal cross-section of catch 20, than the amount of material joining stud 14 to tapered section 15 of seal-element 10, as evidenced in cross-section 16 of seal-element 10, taken in the plane of junction 18 and shown in FIG. 11. (FIG. 11 has been drawn, it should be noted, to the scale of FIGS. 8–10, rather than the scale of FIGS. 4–7.) The actual number of times that some particular catch 20 can actually be reused under real-world conditions of manufacture will depend, of course, on the catch's detailed design, its dimensions, and on its material composition. A minimum, average value of several hundred reuses, with a small variance, should be the goal. If seal-element 10 were to be made of polypropylene and the catch-elements 20 were to be made of polycarbonate, this goal should be easy to meet and to surpass.

It should be observed, however, that catch-elements 20 need not be molded entirely out of a thermoplastic material. Catch-elements 20 might also contain metal, pawl-like elements, such as suggested by the invention of Bingold (op.cit.), or they might contain metal, resilient fingers, such as suggested by the invention of Sauton (op. cit.). Thermoplastics simply offer a particularly efficient and cost-effective means of manufacturing in bulk quantities.

Figure 7:
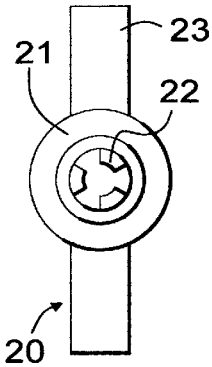
FIG. 7 is a side view of the element shown in FIG. 4 taken through the line 7—7 of FIG. 3.

FIG. 7 shows catch 20 seen along its long axis, and showing in particular three resilient fingers 22 disposed in a regular manner about this axis. The long axis of catch 20 passes through the center of FIG. 7 and is perpendicular to the picture plane.

Figure 8:
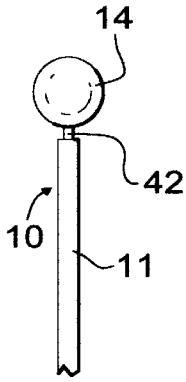
FIG. 8 is a side view of the element shown in FIG. 5 taken through line 8—8 of FIG. 5.

FIG. 8 shows the top assembly of seal-element 10 (that is, seal-midsection 13, and its two, contiguous, tapered sections 15, and their respective, contiguous studs 14) seen end-on through lines 8—8 of FIG. 5, that is, along the axis of radial symmetry of studs 14. The thickness of perforation tooth 42 is clearly less than the thickness of tag 11. For this reason, a twisting force applied to tag 11 and just strong enough to tear perforation tooth 42 will not be strong enough to tear tag 11 itself. The abscission bead constituted by the linear array of perforation teeth 42 will thus tear preferentially.

Figure 9:
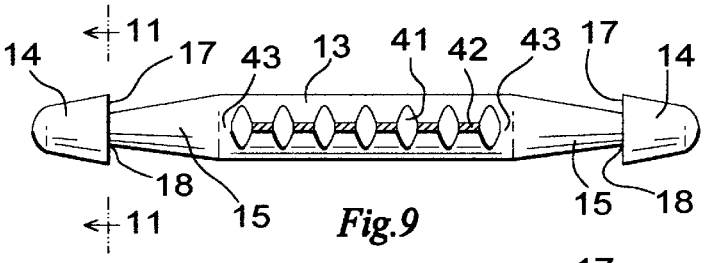
FIG. 9 is a cross-sectional view of the element of the present invention shown in FIG. 5 taken through line 9—9 of FIG. 5.

FIG. 9 shows in cross-section, and in still greater detail than FIG. 5, the abscission bead formed by perforation teeth 42 and perforation holes 41. Each perforation tooth 42 has a very small, cross-sectional area. Comparison with FIG. 11, which shows cross-sectional area 16 of the junction of stud 14 with tapered section 15, reveals that the cross-sectional area of perforation tooth 42 is considerably less than cross-sectional area 16. For this reason and because the minimal, twisting force necessary to tear-off tag 11 from seal-midsection 13 will be applied substantially at right angles to the direction of the pulling force needed to break off stud 14 from tapered section 15, perforation teeth 42 will be severed one at a time until tag 11 is removed, without, however, breaking off stud 14.

Figure 10:
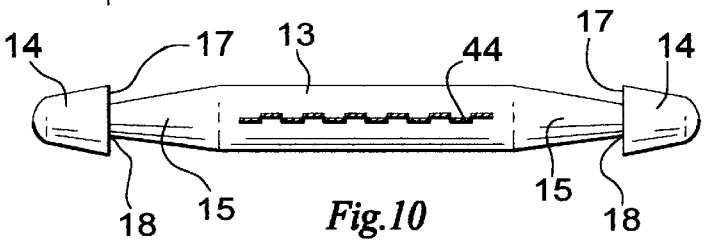
FIG. 10 is a cross-sectional view of an alternate form of the element shown in FIG. 9 taken as in FIG. 9.

FIG. 10 shows an alternate method of attaching tag 11 to seal-midsection 13. In place of perforations holes 41 and perforation teeth 42, the abscission bead is formed from staggered, contiguous elements 44, wherein each staggered element 44 has a rectangular cross-section still smaller in area than the cross-section of a single perforation tooth 42, and wherein staggered elements 44 are located, one after the other, along alternate sides of a line parallel to the length of seal-midsection 13, and with only their corners touching. The combined length of staggered elements 44 is less than the full width of the face of tag 11, so that a gap, similar to gap 43, arises at the opposite ends of this staggered array. Tearing off tag 11, whether tag 11 happens to be attached by perforations 42, as shown in FIG. 9, or by smaller, staggered elements 44, as shown in FIG. 10, produces a staccato, tactile sensation and sound.

Figure 11:
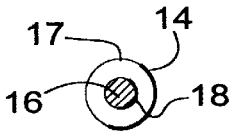
FIG. 11 is a cross-sectional view of the element of the present invention shown in FIG. 9 taken through line 11—11 of FIG. 9.

FIG. 11 has already been described, above.

Figure 12:
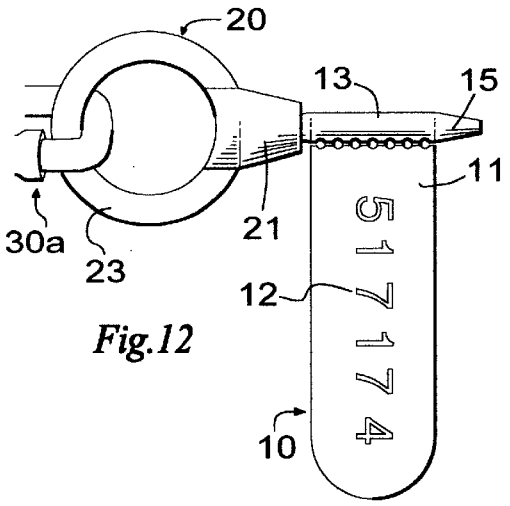
FIG. 12 is an elevation front view of the embodiment of the present invention shown in FIG. 1, but subsequent to the partial destruction of the central element thereof.

FIG. 12 shows seal-element 10 subsequent to the breaking away of one of its studs 14 from the stud's formerly contiguous, tapered section 15. The remainder of seal-element 10 is now in locked engagement with one catch 20 only.

Figure 13:
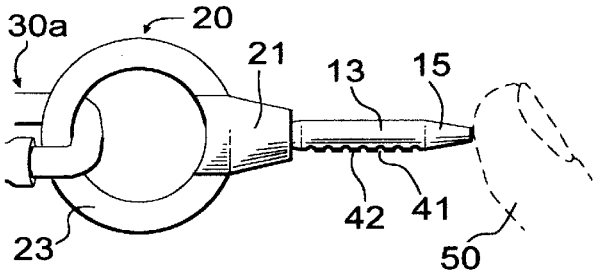
FIG. 13 shows the elements of FIG. 12 in the same perspective, but subsequent to the removal of one of the sub-elements thereof and including a schematic, human finger.

FIG. 13 shows the remainder of seal-element 10 subsequent to the tearing-off of tag 11 from seal-midsection 13. Human finger 50 is about to give a push to the tapered section 15, which formerly had been connected to the now-broken off stud 14.

Figure 14:
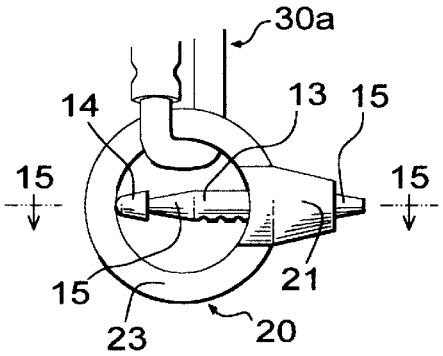
FIG. 14 shows the elements of FIG. 13 in the same perspective, but subsequent to a rotation about an axis perpendicular to the plane of FIG. 13, and further subsequent to the displacement of one of the elements with respect to the other element, and absent the schematic, human finger.

FIG. 14 shows catch 20 rotated about an axis through the center of catch-ring 23 and perpendicular to the picture-plane of FIG. 13. This rotation allows remaining stud 14 to proceed forward as far as possible, that is, without encountering chain 30*a*, when tapered section 15 is pushed. Stud 14 moves forward until it comes into contact with catch-ring 23, as shown.

Figure 15:
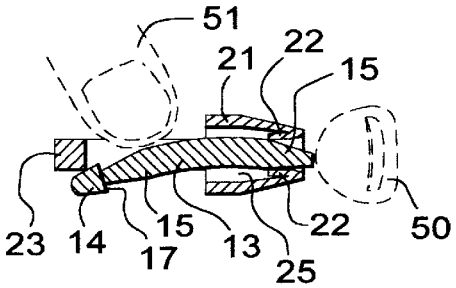
FIG. 15 is a cross-sectional view of the elements shown in FIG. 14 taken through line 15—15 of FIG. 14, and additionally including two, schematic, human fingers.

FIG. 15 shows human finger 51 pushing seal-midsection 13 from the side, while human finger 50 gives an additional push to the still-exposed, tapered section 15. Because the materials from which seal-element 10 and catch-element 20 are made are both resilient and fairly flexible, resilient fingers 22 in catch-housing 21 and seal-midsection 13 itself all yield slightly under pressure and thus allow stud 14 to clear catch-ring 23. In practice, this movement will be relatively slight and brief. Once the movement has been accomplished, the remainder of seal-element 10 may easily be flicked out of the way by means of a fingernail placed against face 17 of stud 14. A new seal-element 10 may then be brought into locked engagement with both catches 20, thus, once again, protecting with a tamper-evident seal whatever it was that the end-user of the present invention desired to protect. That resilient fingers 22 are resilient simply means that they do not retain a memory (there is no material hysteresis) of brief and slight displacements and deformations. Resilient fingers 22 thus spring back to their original position after seal-element 10, less its tag 11, has passed through them.

Figure 16:
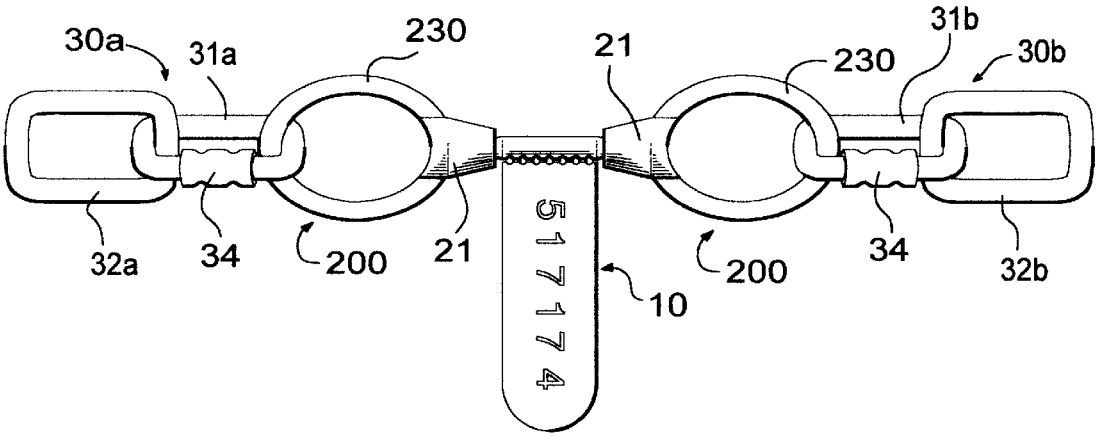
FIG. 16 is an elevation front view of an alternate embodiment of the present invention, showing the elements thereof in locked engagement with one another.

FIG. 16 is nearly identical to FIG. 1, except that catch-ring 23, shown in FIG. 1 to be circular in form, has been replaced in FIG. 16 by elliptical catch-ring 230. Catch 200 is long enough on its own to eliminate the need to bend the remainder of seal-element 10, as shown in FIG. 15, in order to remove it. Other, catch-ring shapes, such as the shape of a chain-link, work well, too, in this regard, provided that they have an inside dimension not less than the length of the remainder of seal-element 10.

FIGS. 15 and 16 show that, even if catch-ring 230 were just sufficiently long as to permit the removal of the remainder of seal-element 10 without having to bend it, direct access to cavity 25 of catch-housing 21 from behind with prying tools, themselves considerably longer than the remainder of seal-element 10, would still substantially be blocked by catch-ring 230. Picking a tamper-evident seal without leaving visible evidence is difficult, to start with, for most good, seal designs. The present invention is an improvement over tamper-evident seals that have fully exposed, catch-housing cavities.

Since certain other changes and modifications apparent to one skilled in the art may be made in the herein described embodiments of the invention without departing from the scope and true spirit thereof, it is intended that all matter contained herein be interpreted in an illustrative, and not in a limiting, sense with respect to the invention claimed in the following claims and equivalents thereto.

I claim:

1. A tamper-evident seal comprising an engaging element and two catch-elements, said engaging element being capable of locking engagement with either, or with both, of said catch elements, said engaging element having a mid-section and an identification element attached thereto, said engaging element further having at least one abruptly-shouldered sub-element at each end, said abruptly-shouldered sub-elements being individually capable of passing through either of said catch-elements, said passing of said abruptly-shouldered sub-elements through either of said catch-elements being permitted in one direction but, after having occurred, being obstructed from occurring in the opposite direction, said midsection of said engaging element being capable of passing in its entirety through one of the two said catch-elements after at least one of the said abruptly-shouldered sub-elements has been severed from the said engaging element and after the said identification element has been removed from said engaging element.

2. A tamper-evident seal as in claim 1, in which said abruptly-shouldered studs are radially symmetric about an axis, and in which said abruptly shouldered studs are rotatable about said axis subsequent to the passage of said abruptly-shouldered studs through either, or through both, of said catch elements.

3. A tamper-evident seal as in claim 1 in which said identification element is attached to said midsection by an abscission bead, said abscission bead being readily tom when some minimally necessary force is applied to said tag, said minimally necessary force, however, being insufficient to tear any other elements of said tamper-evident seal, apart from said abscission bead, when said third, engaging element is in said locking engagement with either, or with both, of said catch-elements.

4. A tamper-evident seal as in claim 3 in which said identification element has a width and said abscission bead has a length, said length of said abscission bead being less than said width of said identification element.

5. A tamper-evident seal as in claim 3 in which said abscission bead is formed by a series of perforation teeth and perforation holes.

6. A tamper-evident seal as in claim 3 in which said abscission bead is formed by a series of staggered elements, said staggered elements of said series being disposed along alternate sides of a line, each said staggered element being contiguous with the staggered element before it in the said series and with the staggered element behind it in the said series, said contiguity, however, occurring only at one shared corner for each contiguous pair of said staggered elements.

7. A tamper-evident seal as in claim 1 in which said catch elements have catch housings and in which said catch elements are adapted for attachment to objects other than the elements of said tamper-evident seal, said adaptation for said attachment at least partially obstructing access to said catch housings.

8. A tamper-evident seal as in claim 7 in which said catch elements have catch rings for effecting said attachment, said catch rings having a largest inside dimension, and in which said tamper-evident seal has a remainder, said remainder being that part of said tamper-evident seal left after removal of said identification element and one of said abruptly shouldered studs, said remainder having a largest dimension, and said largest inside dimension of at least ones of said catch rings being less than said largest dimension of said remainder.

9. A tamper-evident seal as in claim 7 in which said catch elements have catch rings for effecting said attachment, said catch rings having a largest inside dimension, and in which said tamper-evident seal has a remainder, said remainder being that part of said tamper-evident seal left after removal of said identification element and one of said abruptly shouldered studs, said remainder having a largest dimension, and said largest inside dimension of at least one of said catch rings being greater than or equal to said largest dimension of said remainder.

10. A tamper-evident seal as in claim 9 in which at least one of said catch rings is substantially elliptical in shape.

11. A tamper-evident seal as in claim 9 in which at least one of said catch rings is substantially in the shape of a chain link.

12. A tamper-evident seal as in claim 1 in which the material composition of said catch elements is strong relative to the material composition of said third engaging element.

13. A tamper-evident seal as in claim 12 in which said third engaging element is made from polypropylene.

14. A tamper-evident seal as in claim 12 in which said catch elements are made from polycarbonate.

15. A tamper-evident seal as in claim 1 in which said catch elements are reusable, and in which said engaging element may be replaced with a new engaging element drawn from a replacement set, each said replacement set initially containing a plurality of said engaging elements, each said engaging element in said replacement set having a color, the colors of said engaging elements in said replacement set being initially not all the same.

16. A tamper-evident seal is in claim 1, said engaging element having two linear ratchets, each said linear ratchet comprising a plurality of abruptly shouldered sub-elements, said abruptly-shouldered sub-elements being individually capable of passing through either of said catch-elements.

17. A tamper-evident seal as in claim 16 in which said midsection has a longest dimension and a cross-sectional area orthogonal to said longest dimension, and in which said linear ratchets have a maximum cross-sectional area parallel to said cross-sectional area of said midsection, and in which said cross-sectional area of said midsection is geometrically substantially similar to, and is not greater than, said maximum cross-sectional area of said linear ratchets.

* * * * *